US009644454B2

(12) United States Patent
Jani

(10) Patent No.: US 9,644,454 B2
(45) Date of Patent: May 9, 2017

(54) SYSTEM AND METHOD FOR INJECTING FLUID AT SELECTED LOCATIONS ALONG A WELLBORE

(71) Applicant: William Jani, Calgary (CA)

(72) Inventor: William Jani, Calgary (CA)

(73) Assignee: SC ASSET CORPORATION, Calgary, Alberta ( * ) Notice: Subject to any disclaimer, the term of this patent is extended or adjusted under 35 U.S.C. 154(b) by 252 days.

(21) Appl. No.: 14/603,193

(22) Filed: Jan. 22, 2015

(65) Prior Publication Data

US 2015/0226035 A1 Aug. 13, 2015

(30) Foreign Application Priority Data

Feb. 10, 2014 (CA) ..... 2842568

(51) Int. Cl.

| | |
|---|---|
| ***E21B 34/14*** | (2006.01) |
| ***E21B 43/26*** | (2006.01) |
| ***E21B 31/00*** | (2006.01) |
| ***E21B 34/00*** | (2006.01) |
| ***E21B 34/16*** | (2006.01) |

(52) U.S. Cl.

CPC ..... *E21B 34/16* (2013.01); *E21B 31/00* (2013.01); *E21B 34/14* (2013.01); *E21B 43/26* (2013.01); *E21B 2034/007* (2013.01)

(58) Field of Classification Search

CPC .... E21B 43/26; E21B 34/14; E21B 2034/007; E21B 34/16; E21B 31/00; E21B 43/267; E21B 33/12; E21B 34/06

See application file for complete search history.

(56) References Cited

U.S. PATENT DOCUMENTS 5,513,703 A * 5/1996 Mills ..... E21B 34/14 166/316

7,926,580 B1 * 4/2011 Darnell ..... E21B 17/20 166/373

* cited by examiner

*Primary Examiner* — Wei Wang

(74) *Attorney, Agent, or Firm* — Gowling WLG (Canada) LLP; D. Doak Horne

(57) ABSTRACT

A system and method for selectively actuating sliding sleeves in valve sub-members which are placed downhole in a wellbore, via one or more darts inserted into said wellbore, to thereby open a ports or ports in such sub-members to allow fracking of the wellbore. The dart is preferably coupled, or provided with coupling means to permit coupling, to a retrieval tool, which upon the retrieval tool being so coupled allows a bypass valve to be opened to thereby assist in withdrawing the dart from within the valve sub-members. Upward movement of the retrieval tool allows a wedge-shaped member to disengage the dart member from a corresponding actuated sleeve to allow the dart to be withdrawn from the wellbore.

11 Claims, 7 Drawing Sheets

SYSTEM AND METHOD FOR INJECTING FLUID AT SELECTED LOCATIONS ALONG A WELLBORE

PRIORITY AND CROSS-REFERENCE AND RELATED APPLICATIONS

This application claims priority from commonly-invented and commonly-owned Canadian patent application no. 2,842,568, filed Feb. 10, 2014, and incorporates by reference in its entirety such corresponding, earlier filed application as well as corresponding U.S. patent application Ser. No. 14/178,056 filed with the United States Trademark and Patent Office on Feb. 11, 2014.

FIELD OF THE INVENTION

The present invention recited herein relates to a system and method for opening ports at one or more locations along a length of a wellbore to permit injecting fluid at said one or more locations, such as for example in a selective fracking operation. The system and method allows for subsequent production from the wellbore without having to utilize a reamer or milling device to remove dart members which were previously placed in such wellbore to selectively open the ports in the wellbore.

BACKGROUND OF THE INVENTION

Of interest to one aspect of the present invention relating to selective opening of ports of a plurality of valve subs within a fracking string to allow fracking of a formation at discrete/selected intervals along a wellbore, prior art designs such as those disclosed in U.S. Pat. No. 6,907,936 (esp. FIG. 1b & FIGS. 3A, 3B), U.S. Pat. No. 6,095,541, US 2006/0124310, and SPE 51177 (September 1998) generally teach a number of valve subs each having a sliding cylindrical sleeve and an associated circular ball seat therein. The slidable sleeve covers a frac port to keep it closed when the sleeve is in a first (closed position), and the sleeve may be moved to a second (open) position which uncovers the frac port to allow frac fluid to be supplied through a pre-perforated casing to thereby fracture the formation.

In one aspect of such prior art a ball seat is provided for each slidable sleeve. The ball seat for each slidable sleeve reduces in diameter for each sleeve of an associated valve sub the further downhole a particular valve sub and associated sliding sleeve is placed downhole.

In operation, to progressively open frac ports within each of the valve subs, commencing with the most downhole valve sub-member, a first ball of small diameter is injected downhole and flows past larger diameter ball seats in associated valve subs [thereby leaving the slidable sleeve therein in a position covering the frac ports] until the most downhole sleeve is reached having the smallest diameter ball seat, which ball seat is smaller in diameter than the first ball. The first ball's further downhole motion is thus arrested by the smaller-diameter ball seat, and fluid pressure uphole of the ball forces the first ball, the ball seat, and associated slidable sleeve to move downhole, thereby uncovering and thus opening the frac port within the most downhole valve sub. Fluid under pressure is continued to be injected and pumped down the wellbore to frac the formation in the location of the open port in such wellbore. Thereafter, a second ball, of slightly larger diameter, is injected downhole, which second ball is larger in diameter than the ball seat as contained in the second-lowermost (downhole) valve sub. Now the second ball's further downhole motion is thus arrested by the smaller-diameter ball seat, and fluid pressure uphole of the second ball forces the first ball, the ball seat, and associated slidable sleeve to move downhole, thereby uncovering and thus opening the frac port within the second most downhole valve sub.

The above process is repeated, using progressively larger diameter balls, until all of the slidable sleeves in each of the valve subs has been opened, and the formation fractured in the region of the open frac ports of each of the valve subs.

Thereafter, a milling sub is passed through the bore of each of the valve subs to mill out and thereby remove each of the balls and ball seats, to thereby allow hydrocarbons flowing into the valve sub to be freely pumped up to surface.

Such prior art method and apparati possess at least four distinct disadvantages.

Firstly, one shortcoming of the ball valve seat mechanisms as described above is that such mechanism cannot be cemented into place within a casing due to the fact there is no way to then clean or wipe the cement out of the ball seat mechanism for subsequent use. Such prior art systems thus typically need to be used with a liner with open hole packers, which adds to the cost.

A second disadvantage is that due to the progressively decreasing diameter of the ball seat in each of the valve subs, the volume and rate of fracking fluid flow is thus seriously and undesirably restricted in the most downhole regions of the wellbore, and typically a flow rate of 15 cubic meters per minute [with wellbores of the typical 6-9 inch (15-23 cm) diameter] cannot be obtained.

A third disadvantage of the "graduated size ball drop" mechanisms of the prior art is that due to the need to have a plurality of balls of different (but distinct) diameters, the number of valve subs can typically be no greater than 23 stages, and thus typically no more than 23 areas along a wellbore can be fracked at a single time, unless one or more ball seats incorporate a release mechanism such as that disclosed in U.S. Pat. No. 4,893,678 (i.e. a "kickover" mechanism) to allow the ball to pass through the associated ball seat after having actuated the sliding sleeve to open the associated port, to allow additional one or more downhole subs to have their respective frac ports opened by the same valve.

A forth disadvantage is that a milling operation may need to be conducted, after fracking, to remove the balls to allow the well to be pumped.

In order to overcome the above disadvantages with the prior art graduated-size ball drop mechanisms and methods, US 2013/0168098 (CA 2,797,821) (having a common inventor to the present invention) teaches in one embodiment a dart 22, as shown in FIGS. 7-9 thereof, having "keys" 42, which keys 42 only engage the keyways 32 of a corresponding valve sub 10 (ref. FIG. 5 and para. [009], [0039], with the keys 42 becoming progressively wider with each successive valve sub 10 disposed in well casing 49 towards the top of well 46. Finer graduations in dart key width and corresponding sleeve groove width can be implanted, and in doing so, it was postulated in such application that the number of valve subs in a single casing string could be increased to something in the range of 16 to 30 or more.

Notably, however, the keyways in such configuration run longitudinally of the valve sub, and are not circumferential, as is clear from FIG. 6 thereof.

In an alternative configuration shown in FIGS. 12A-15 of US 2013/0168098, a dart 22 (ref. FIG. 14 thereof) is provided, having a key profile 54 which is biased towards the inner wall of sliding piston (sleeve) 20 (ref. para. [0044]. When the key profile 58 on a particular dart 22 matches a key profile on piston 20 within a particular valve sub 10, the keyways engage and the piston 20 is caused to move. Specifically, as noted at para. [0048], in such embodiment dart 22 can travel through casing 49 until it reaches a matching key profile 54, where it then latches into piston 20 and locking shoulder 56. The top of dart cup 44 on dart 22 can form a seal within valve body 12, and shear pins 25 are then caused to shear under fluid pressure exerted on dart 22 which causes engaged piston 20 to move down the well, to thereby open ports 14, which can then supply fluid pressure to the formation at such location. FIGS. 15*a*, 15B, 15C, 15D show a series of possible key profiles 54 and dart profiles 58 for such embodiment. Notably, however, all of such profiles teach a plurality of grooves in the interior surface of piston (sleeve) 20, with the "keying" dependent on the relative number and spacing of the grooves relative to each other to provide the selective "keying" arrangement.

Disadvantageously, while such above design of US 2013/0168098/CA 2,797,821 eliminates the problem of reduced bore diameter and consequent restriction of flow of fluid, such as fracking fluid and moreover further increases the number of possible valve subs which can be used due to the infinite number of "key" combinations using different numbers and relative spacing between the circumferential grooves formed on the inner wall of piston 20 which form the key profile 54 [ref. para. 0044], machining of piston/sleeve 20 and darts 22 in the manner disclosed in US 2013/0168098 becomes unduly time-consuming and expensive.

CA 2,860,134 (WO 2013/048810) entitled "Multizone Treatment System" at inter alia FIG. 2 thereof teaches a system and method for successively selectively opening a number of sliding sleeves along a wellbore to allow fluid injection at the location of each of the sliding sleeves. The sliding sleeves each have a circumferential radial groove, the width of which differs, becoming progressively larger for each valve sub-members the more downhole the valve sub and associated sliding sleeve may be positioned. Again, however, and disadvantageously, after fracking of the well, a reamer must be inserted downhole to remove all dart members which have become coupled to associated sleeves, to thereby "open up" the wellbore for maximum production. No bypass is disclosed, for use in removing the dart members.

This background information is provided for the purpose of making known information believed by the applicant to be of possible relevance to the present invention. No admission is necessarily intended, nor should be construed, that any of the preceding information, or the reference in the drawings to "prior art" constitutes prior art against the present invention.

SUMMARY OF THE INVENTION

The present system method overcomes the problem of the prior art wherein dart members which remained in a wellbore after fracturing had to be reamed our milled out by a special downhole tool in order to render the wellbore, after fracturing operations had taken place, for production. Such prior art systems/methods required the use of special milling tools or reamers, and was both time consuming, expensive, and further ran the risk of milled metal residue and chips clogging ports in the wellbore and thus reducing the ability of the wellbore to produce oil.

It is thus an object of the present invention to provide a system/method for selectively opening a plurality of selected frac ports along a wellbore by injecting or placing a dart member or series of dart members in a wellbore, and further being able to remove such dart member(s) after they have selectively opened the desired frac ports without having to drill or mill out such dart member(s).

It is a further object of the present invention to provide a system/method for accomplishing the above which further provides a system/method for injection of a washing fluid in the particular region of the dart member(s) to thereby reduce the tendency of sand impaction and the tendency for dart members to remain impacted in a wellbore after injection of fracturing fluids.

It is yet a further object of the present invention to provide a selectively openable bypass port within each valve sub-member, which port allows pressure equalization and/or allows a washing fluid to be introduced in the region of a dart member, each of which together assists in being able to better and more easily withdraw the dart member(s) from the wellbore by a retrieving tool and thus reduces the tendency of the dart members to become lodged within the wellbore.

It is yet a further object of the present invention to provide a system/method which is able to reliably selectively open, using individually "keyed" dart members, a substantial number of similarly keyed sliding sleeves, with a near-infinite number of key configurations which may be deployed, and thereby not be limited by finite number of ball sizes which thereby correspondingly translates into a finite number of frac ports which may be opened by a graduated ball-drop system of the prior art.

It is yet a further object of the present invention to provide a system/method which reliably provides all of the above features.

Accordingly, in a first broad embodiment of the invention, such invention comprises a system for permitting injection of fluid into an underground formation at one or more selected locations along a longitudinal length of a wellbore within said underground formation, and thereafter leaving the wellbore substantially free of dart members thereby eliminating the need to drill out of one or more of said dart members to allow for subsequent production from the wellbore, the system comprising:

(i) a plurality of hollow cylindrical valve sub-members insertable in said wellbore, each having coupling means at opposite ends thereof for physically coupling said valve sub-members together in an end-to-end relation, each valve sub-member having a bore and at least one of said sub-members having a radial frac port for permitting radial egress of fluid from within said bore of said at least one valve sub-member to an exterior of said at least one valve sub-member and thereby into said underground formation when said sub-members are inserted in said wellbore;

(ii) a hollow cylindrical slidable sleeve, said hollow slidable sleeve:

longitudinally slidable within said one of said valve sub-members, from a first closed position where it is initially maintained via a shear pin in a position covering said radial frac port, to an longitudinally downhole second open position where said radial frac port is uncovered by said hollow slidable sleeve;

having a key profile in an interior surface thereof; and having lock means configured to maintain said hollow slidable sleeve in said open position when said slidable sleeve is moved to said open position from said closed position;

(iii) a dart member, having a hollow bore, insertable within said slidable sleeve, having a cylindrical radially-outwardly biased key portion thereon configured to engage said key portion on said slidable sleeve when said dart member passes within said hollow slidable sleeve and allow said dart member to thereby engage and couple said dart member to said slidable sleeve to move said hollow slidable sleeve downhole from said closed position to said open position, said dart member further comprising:

(a) a wedged member, slidably moveable within said dart member, having a wedge-shaped portion thereon positioned downhole of said radially-outwardly biased key portion which wedge-shaped portion when pulled uphole depresses said radially-outwardly biased key portion thereby causing disengagement of said key portion with said circumferential groove to permit said dart member to be withdrawn uphole by a retrieving tool;

(b) a radial bypass port;

(c) a slidable member, covering, in a first position, said radial bypass port and not covering said radial bypass port when in a second position; and (iv) an elongate retrieving tool.

Using the above system, a single dart member may be forced downhole to sequentially actuate (i.e. open) a succession of selected frac ports, with other dart members, having a different key profile, used to actuate other frac ports.

Alternatively, a plurality of dart members, coupled together, each of a different key profile, may be used to simultaneously actuate a corresponding plurality of valve subs.

A pressurized fluid may be used to propel such dart member(s) downhole, or alternatively such dart members may be positioned on the end of coil tubing and such coil tubing used to place such dart members at the desired location along the wellbore to engage respective sliding sleeves. The coil tubing, or another tool such as a retrieving tool, may then be used for retrieving the dart member(s) after the desired frac ports have been opened and fracturing of the wellbore at the desired locations been completed.

In the above system, the cylindrical radially-outwardly biased key portion of the dart, when the dart is forced downhole within said hollow cylindrical sub-members, engages the key profile on said slidable sleeve and thereby couples the dart member to the slidable sleeve, thereby allowing the slidable sleeve to be moved by said dart member downhole to thereby open said radial frac port and thereby permit injection of a fluid into said formation.

The retrieving tool, in one embodiment, when affixed to said dart member, moves said slidable member to said second position to expose said radial bypass port. In an alternative embodiment, the retrieving tool is adapted to be coupled to said dart member and is further adapted upon movement uphole of said retrieving tool and dart member, to move the slidable member to said second position to thereby expose the radial bypass port.

In both embodiments the radial bypass port is provided within each valve sub-member which is desired to be actuated, and allows pressure equalization and/or a washing fluid to be introduced in the region of a dart member, when the dart is being removed by the retrieving tool, to reduce the tendency of the dart members to become lodged within the wellbore.

In a preferred embodiment, the key profile on the slidable sleeve comprises a circumferential groove about the interior surface of the slidable sleeve, and the cylindrical radially-outwardly biased key portion on the dart member comprises at least one radially outwardly protruding annular member of a width less than or equal to the circumferential groove on the slidable sleeve that it is intended to engage.

In an embodiment of the system where the retrieving tool is adapted to be coupled to said dart member and is further adapted, upon movement uphole of the retrieving tool and dart member thereby moving the slidable member to a second position to expose the radial bypass port, the slidable member is coupled to said wedge-shaped member, and the retrieving tool is coupled to said slidable member. Movement of the retrieving tool uphole causes said slidable member to move to the second position exposing said bypass port and causing said wedge-shaped member to disengage the dart member from the key profile of said slidable sleeve. A washing fluid may further be introduced, typically via coil tubing, the distal end of which is used as both the retrieving tool and for providing washing fluid in the region of the dart member(s) to prevent sand impaction by flushing any sand-laden fluids in such region wherein the washing fluid then passes uphole via the annular region between the coil tubing and the bore of the sub-members.

In a preferred embodiment, a plurality of sub-members respectively contain a corresponding plurality of slidable sleeves, each slidable sleeve having said circumferential groove, each circumferential groove of a lesser width than the cylindrical groove within a slidable sleeve of a most proximate downhole valve sub-member to allow displacement of selective of said slidable sleeves. Each slidable sleeve is engaged by a corresponding dart member. In such preferred embodiment each dart member comprises a radially-outwardly biased member having a key profile comprising an annular member of a width equal or lesser than that of the circumferential groove on the sliding sleeve that it is intended to engage, in order to engage such groove.

Alternatively, the circumferential groove in each slidable sleeve, and each radially outwardly biased key portion on each dart member, may be comprised of a plurality of corresponding grooves and raised and uniquely spaced annular members, which then function as a unique "key", permitting a single dart to engage only similarly "keyed" sliding sleeves, and thus only actuate selected sleeves so as to open the respective frac ports.

In one embodiment a single dart is employed to successively actuate, as it passes downhole under fluid pressure or when located at the distal end of a tool, a plurality of sliding sleeves. In such an embodiment:

a) the circumferential groove in an uphole slidable sleeve within an uphole valve sub-member is of the same width as a cylindrical groove of a downhole slidable sleeve within an adjacently coupled downhole valve sub-member; and b) the adjacent downhole or uphole valve sub-member has a contact surface for depressing inwardly said radially-outwardly biased member on the dart member when the slidable sleeve in an uphole sub-member has repositioned to the open position, so as to permit the dart member to be disengaged from said circumferential groove in said slidable sleeve and thereafter continue to progress downhole for further engagement/actuation with one or more similarly "keyed" slidable sleeves of downhole valve sub-members, to thereby open further downhole radial frac ports in said downhole valve sub-members.

In all embodiments it is preferred, particularly where a washing/flushing step is desired to be employed, that the dart member(s) possess a seal member, typically in the form of a cup seal, situated uphole from said radially-outwardly biased key portion and downhole from the radial bypass port (i.e. the radial bypass port is situated on said dart member uphole from the seal member). In such manner the bypass port will be closed during fracking as the seal will prevent the frac fluid from moving downhole and cause it to pass out the (opened) frac port and thereby into the hydrocarbon formation. Thereafter, the washing fluid can be injected in the region of the bypass port and thus the seal member (cup seal), to flush entrapped residual sand or proppant which may have entered the bore of the valve member by way of "backwash" after the fracking operation.

In another broad aspect of the invention, the invention comprises a method of operating the system as described above.

In such additional broad aspect the present invention comprises a method of opening at least one radial frac port along a wellbore via a dart member to thereby allow injection of fluid into a hydrocarbon formation via said frac port, and thereafter using a retrieving tool to further open a bypass valve and allow removal of both the retrieving tool and the dart member from the wellbore while reducing sand impaction, comprising the steps of:

(A) providing:

(i) a plurality of hollow cylindrical valve sub-members insertable in said wellbore, each having coupling means at opposite ends thereof for physically coupling said valve sub-members together in an end-to-end relation, each valve sub-member having a bore and at least one of said sub-members having a radial frac port for permitting radial egress of fluid from within said bore of said at least one valve sub-member to an exterior of said at least one valve sub-member and thereby into said underground formation when said sub-members inserted in said wellbore;

(ii) a hollow cylindrical slidable sleeve, said hollow slidable sleeve:

longitudinally slidable within said one of said valve sub-members, from a first closed position to an longitudinally downhole second open position where said radial frac port is uncovered by said hollow slidable sleeve;

having a key profile in an interior surface thereof; and having lock means configured to maintain said hollow slidable sleeve in said open position when said slidable sleeve is moved to said open position from said closed position;

(iii) a dart member, having a hollow bore, insertable within said slidable sleeve, having a cylindrical radially-outwardly biased key portion thereon, configured to engage said key profile on said slidable sleeve when said dart member passes within said hollow slidable sleeve and allow said dart member to be coupled to said slidable sleeve and cause said slidable sleeve to move downhole from said closed position to said open position, said dart member further comprising:

(a) a wedge member, slidably moveable within said dart member, having a wedge-shaped portion thereon positioned downhole of said radially-outwardly biased key portion which wedge-shaped portion when pulled uphole depresses said radially-outwardly biased key portion thereby causing disengagement of said key portion with said circumferential groove to permit said dart member to be withdrawn uphole by a retrieving tool;

(b) a radial bypass port;

(c) a slidable member, covering, in a first position, said radial bypass port and not covering said radial bypass port when in a second position;

(iv) a retrieving tool, having a hollow bore;

(B) inserting said slidable sleeve into said bore of at least one of said valve sub-members;

(C) coupling said valve sub-members together in an end-to-end relation, and inserting them downhole in said wellbore;

(D) forcing said dart member downhole in said wellbore until said cylindrical radially-outwardly biased key portion on said dart member engages said key profile in said slidable sleeve and causing slidable displacement of said sliding sleeve from said first position to said second position thereby opening said radial frac port;

(E) injecting a fluid into said hydrocarbon formation via said opened frac port;

(F) ceasing injection of said fluid;

(G) lowering said hollow retrieving tool into said wellbore and coupling said retrieving tool to an uphole end of said dart member, and via said retrieving tool, sliding said slidable member downhole to thereby open said bypass port;

(H) injecting a washing fluid into said hollow bore of said retrieving tool and causing same to flow through said bypass port and into the bore of the valve subs and to be flushed uphole and/or out said frac port; and (I) withdrawing said retrieving tool and said dart member from said wellbore.

In a first embodiment of the above method, the forcing of the dart member downhole is caused by application of fluid pressure on the uphole side of the dart member.

In another alternative embodiment of the above method, the forcing of the dart member downhole is caused by an insertion tool having at its distal end said dart member, and by forcing said dart member and insertion tool downhole.

In a preferred embodiment of the foregoing methods, the key portion on said slidable sleeve comprises a circumferential groove.

The above summary of the system and method of the present invention does not necessarily describe the entire scope of the present invention. Other aspects, features and advantages of the invention will be apparent to those of ordinary skill in the art upon a proper review of the entire description of the invention as a whole, including the drawings and consideration of the specific embodiments of the invention described in the detailed description.

BRIEF DESCRIPTION OF THE DRAWINGS

The following figures depict one embodiment of the system and method of the present invention. For a full definition of invention, reference is to be had to the specification as a whole, including the Summary of the Invention, the Detailed Description of Some Embodiments, and the claims.

The following Figures describe such single embodiment, in which:

FIGS. 1-6 show a side cross-sectional view of a system incorporating one embodiment of the present invention, and in particular together show a sequence the successive steps for the method of the present invention and the operation of the system of the present invention, wherein:

FIG. 1 shows a side cross-sectional view of such system, wherein the frac port is initially closed by a sliding sleeve and a dart member is being lowered or forced by pressure downhole to open such frac port;

FIG. 2 is a view of such system whereby the dart member has then moved the sliding sleeve so as to open the frac port, and such dart member is becoming disengaged from the sliding sleeve and is about to move (or be moved) further downhole to actuate (i.e. open) further downhole frac ports;

FIG. 3 is a view of such system where the dart member has moved downhole to engage a selected sleeve and further likewise open such selected sleeve, where further downhole movement is prevented, and where a frac fluid is injected in the bore of valve sub members so as to flow into the hydrocarbon formation via opened frac ports 50;

FIG. 4 is a view of the most downhole valve sub-member prior to the dart member being disengaged from the sliding sleeve, and when a retrieving tool is being positioned to become coupled to the dart member and to further open a bypass port by moving a sliding member;

FIG. 5 is a view of the most downhole valve sub-member prior to the dart member being disengaged from the sliding sleeve, but after the retrieving tool has been coupled to the dart member and opened a bypass port by moving a sliding member, and a washing jet of fluid is employed to flush any sand to thereby allow the dart member to be freely removed;

FIG. 6 is a view of the most downhole valve sub-member after the dart member has been disengaged from the sliding sleeve, and is being removed from the wellbore by the retrieving tool;

FIGS. 7A & 7B, 8A & 8B, 9A & 9B, and 10A & 10B show an alternative embodiment of the invention, wherein:

FIGS. 7A & 7B together form a single view of a pair of valve sub-members, with FIG. 7A depicting an uphole valve sub-member, and FIG. 7B depicting the most downhole valve sub-member, in accordance with another embodiment of the system/method of the present invention, wherein the sliding sleeves of each valve sub are about to be respectively actuated by a pair of dart members;

FIGS. 8A & 8B together form a single view of a pair of valve sub-members in accordance with the aforesaid embodiment of FIG. 7A,7B, wherein the pair of dart members have actuated the respective sliding sleeves so as to open the respective frac ports, and are each about to become disengaged from the respective sliding sleeve;

FIGS. 9A & 9B likewise together form a single view of a pair of valve sub-members in accordance with the aforesaid embodiment of FIG. 7A,7B, wherein each dart member has become disengaged from the respective sliding sleeve member;

FIGS. 10A & 10B likewise together form a single view of a pair of valve sub-members in accordance with the aforesaid embodiment of FIG. 7A,7B, wherein a retrieving tool is being used to pull each of the dart members uphole and thus remove same from a wellbore.

DETAILED DESCRIPTION OF PREFERRED EMBODIMENTS

Figure 1:
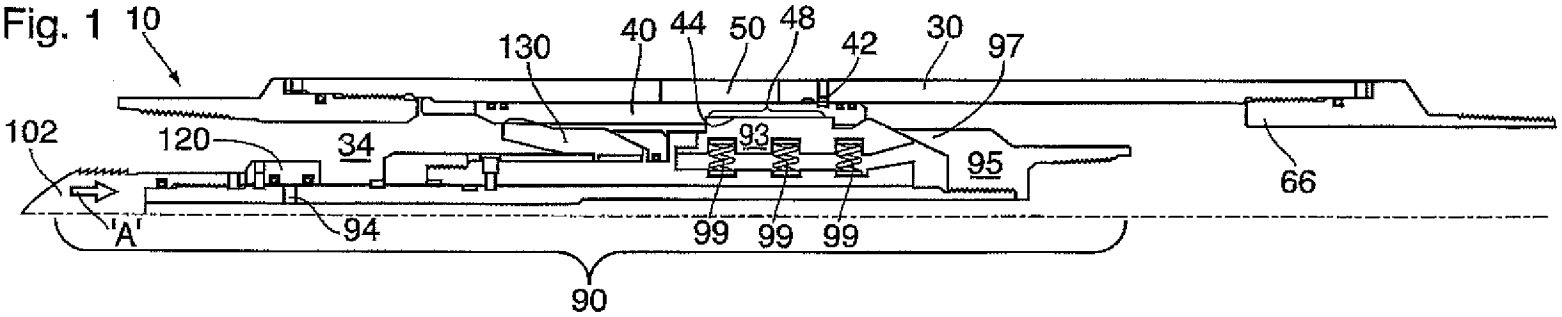

FIGS. 1-6 show a side cross-sectional view of a system and method 10 of the present invention, and in particular together show a sequence the successive steps for the method of the present invention for permitting injection of a fluid into an underground formation (not shown) along a longitudinal length of a wellbore within the underground formation, and thereby leaving the wellbore substantially free of dart members.

As seen from FIGS. 1-6, one valve sub-member 30 of a plurality if valve sub-members 30 (hereinafter "valve subs") is shown, having coupling means 32 at opposite ends thereof for coupling valve subs 30 together in end-to-end relation. Each valve sub 30 has a bore 34 and a radial frac port 50, for permitting radial egress of fluid (typically a fracking fluid, which may contain constituents such as acids, proppants, and the like) from within said bore 34 of each of said valve subs 30 to an exterior thereof and thereby into the underground formation when the valve subs 30 are inserted in a wellbore (not shown).

Figure 3:
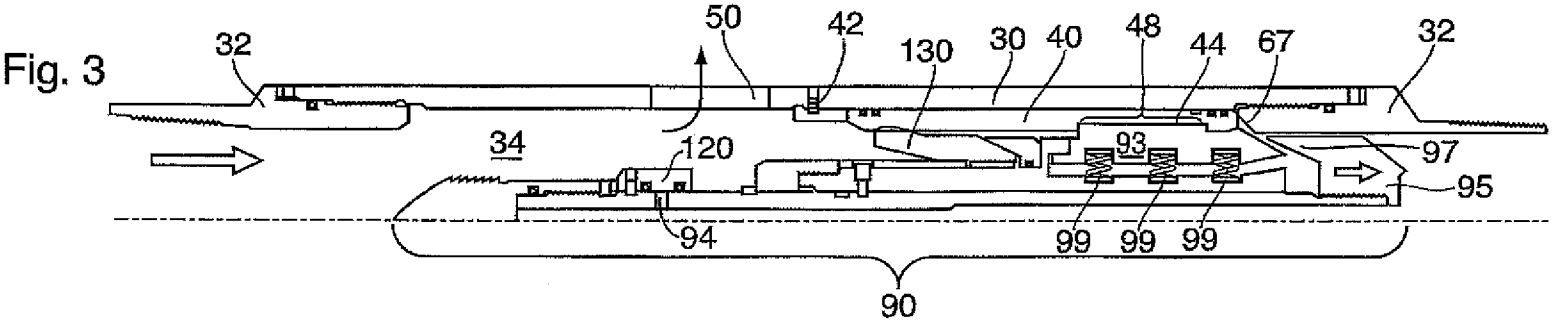

Each valve sub 30 is provided with a hollow cylindrical slidable sleeve 40, longitudinally slidable within a respective valve sub 30 from a first closed position where it is initially maintained by a shear pin 42 in a position covering radial frac port 50 which shear pin 42 serves as a lock means to initially maintain such hollow slidable sleeve in such first closed position (see FIG. 1), to a second longitudinally downhole open position where radial frac port 50 is uncovered and frac fluid injected into bore 34 of valve subs 30 may thereby flow out such frac port 50 (see FIG. 3).

Figure 8A:
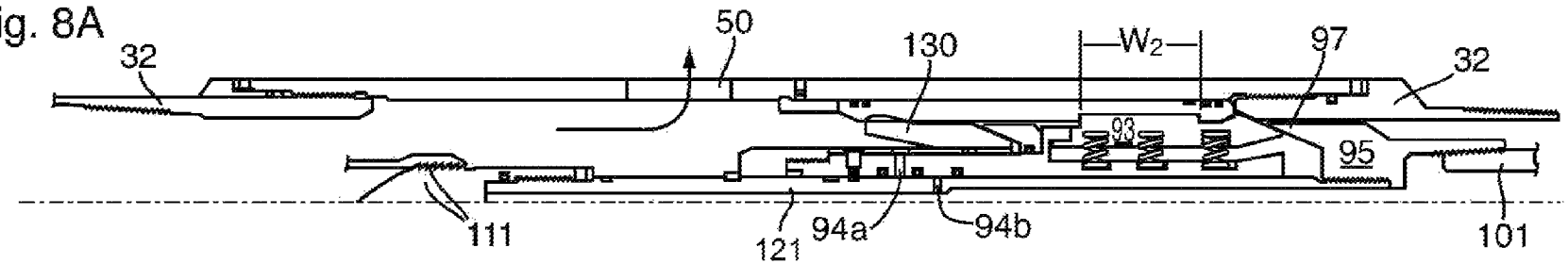
Figure 7B:
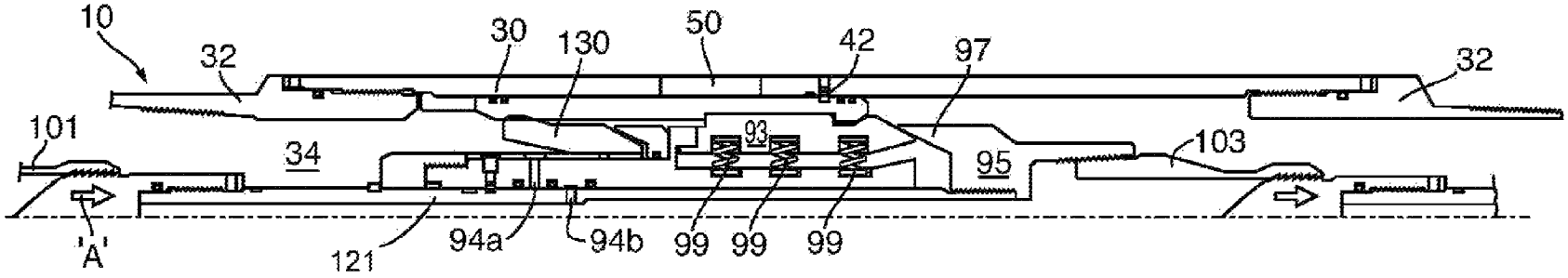
Figure 8B:
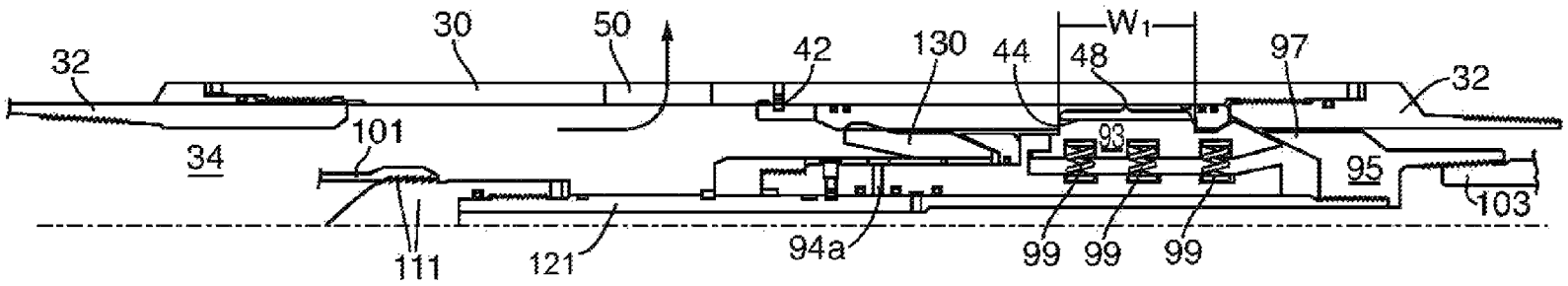

Slidable sleeve 40 is provided with a "key" profile 44 on an interior surface 46 thereof. In a preferred, non-limiting embodiment, such key profile 44 comprises at least one circumferential groove 48 of a given width W1 (ref. FIG. 8B). Other additional uphole sliding sleeves 40 which may further be employed in a frac string system 10 and which are desired to be independently actuated (ref. FIG. 8A) would possess a similar circumferential groove 46 but of a lesser width (e.g. width W2—ref. FIG. 8A) to ensure a different key profile 44 and thus that no inadvertent unintended actuation of uphole sliding sleeves 40 occurs for a given inserted dart member 90.

Alternatively, in order to provide more unique key profiles 44 between various sliding sleeves 40, "key" profile 44 for each sliding sleeve 40 comprise a plurality of longitudinally spaced circumferential grooves 48 of same or different widths. The width of the groove(s) and/or longitudinal separation distance between grooves 48 differs between individual sliding sleeves 40, so that each individual sliding sleeve in a frac string system 10 has a unique "key" profile.

The system 10 further comprises a dart member 90 which is forcibly inserted downhole (by means of uphole fluid pressure, or using an insertion tool) for selectively actuating one or more sliding sleeves 40 for selectively opening frac ports 50 in such frac system 10. Each dart member 90 is provided with a hollow bore 91, and has a cylindrical radially-outwardly biased key portion 93 thereon, which key portion 93 is configured to engage key profile 44 on a particular slidable sleeve 40 or sleeves 40 when dart member 90 passes with hollow slidable sleeve 40, whereupon further downhole movement of dart member 90 causes sliding sleeve 40 to move to the open position (cf. FIG. 1—sliding sleeve 40 in closed position with FIGS. 2-5 where sliding sleeve 40 has been moved to the open position uncovering radial frac port 50). Radially-outwardly biased key portion 93 may be outwardly biased by coil springs 99 as shown in FIGS. 1-6 and FIGS. 7A-10B, but may other biasing means will now occur to persons of skill in the art.

Figure 2:
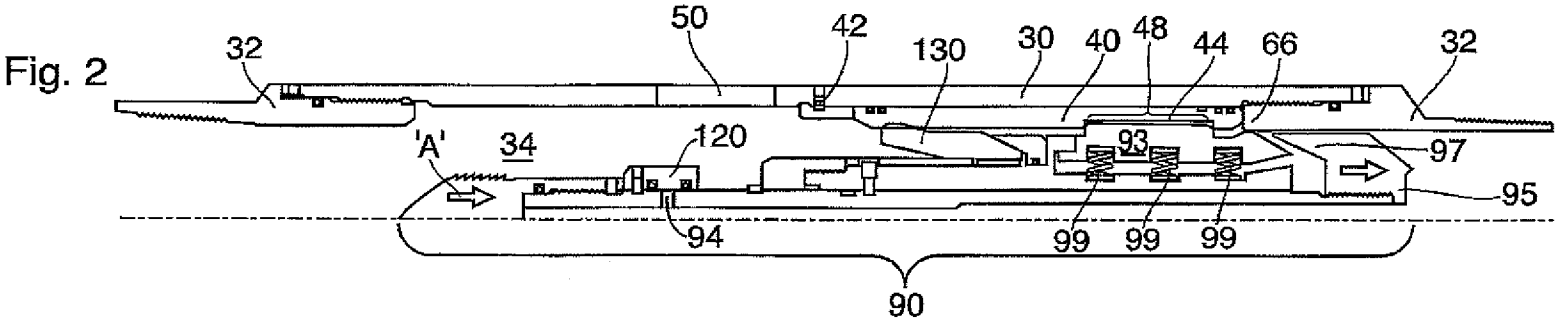
Figure 6:
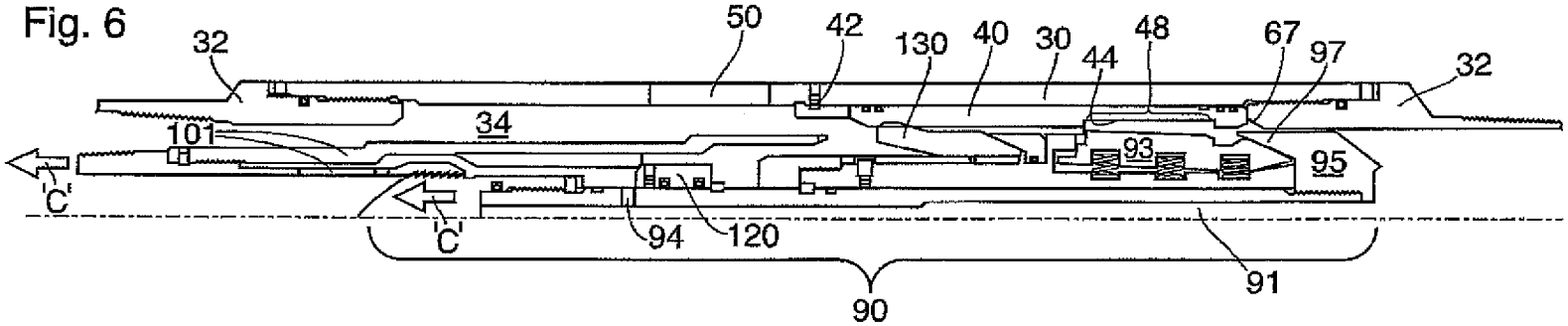

Dart member 90 further possesses a wedge member 95, longitudinally slidably moveable within dart member 90, having a wedge-shaped portion 97 thereon positioned downhole of key portion 93, which wedge-shaped portion 97 when pulled uphole by a retrieving tool 101 depresses the key portion 93 on dart member 90, thereby causing disengagement of with said circumferential groove(s) 48 on respective sliding sleeve 40, to permit said dart member 90 after opening of sliding sleeve 40 and injection of frac fluid into the formation via port 50 (ref. FIG. 2) to be withdrawn uphole by retrieving tool 101 (ref. FIG. 6).

Dart member 90 is further provided with a bypass port 94, to assist in removing dart member 90 from within valve sub 30 and withdrawing such dart member 90 uphole, in the manner further explained below. In the system 10 of the present invention shown in FIGS. 1-5, bypass port 94 may be located on dart member 90 uphole from key portion 93.

Figure 4:
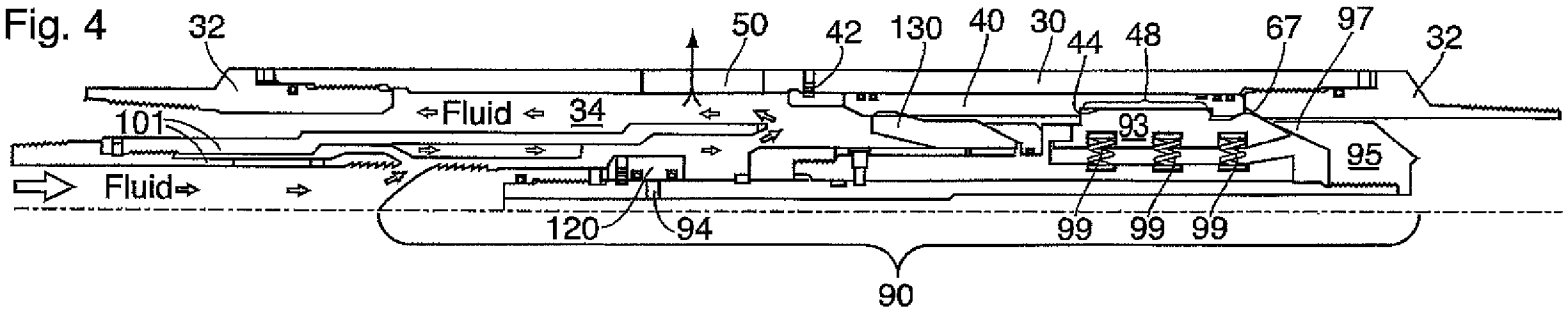

The embodiment shown in FIGS. 1-6 contemplates uses of a slidable member 120 to initially retain radial bypass port 94 in a closed position when fluid is injected into bore 34 (ref. FIG. 3) and subsequently into a hydrocarbon formation via frac port 50. Thereafter, at the time of lowering retrieving tool 101 and coupling retrieving tool 101 to dart member 90 as shown in FIG. 4, such retrieving tool 101 at such time moves slidable member 120 longitudinally downhole so as to uncover radial bypass port 94, allowing a washing fluid injected into the interior 91 of hollow retrieving tool 101 to then flow into valve sub interior 34 and out frac port 50, thereby removing any remaining frac fluid and/or entrained sand. Alternatively, or in addition, bypass port 94 allows, through equalization of pressure, dart member 90 which typically possesses a seal member in the form of a cup seal 130 thereon, to together be withdrawn from within valve sub 30 and further be withdrawn uphole to surface.

Figure 9A:
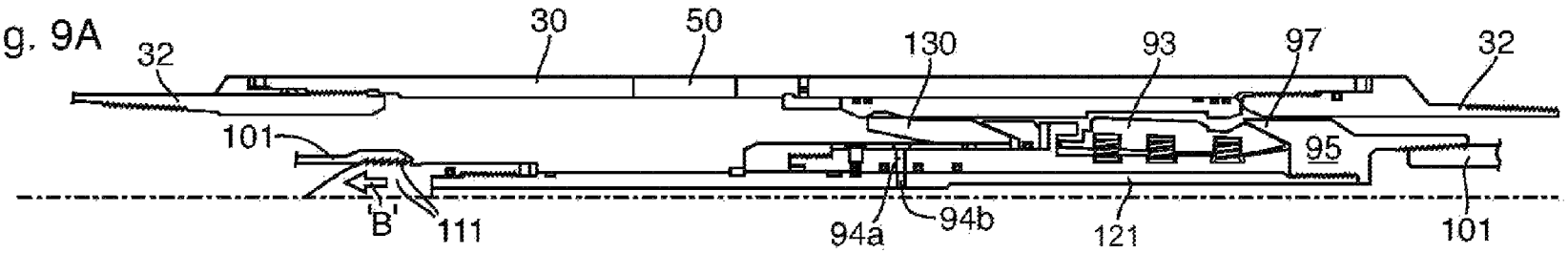
Figure 10A:
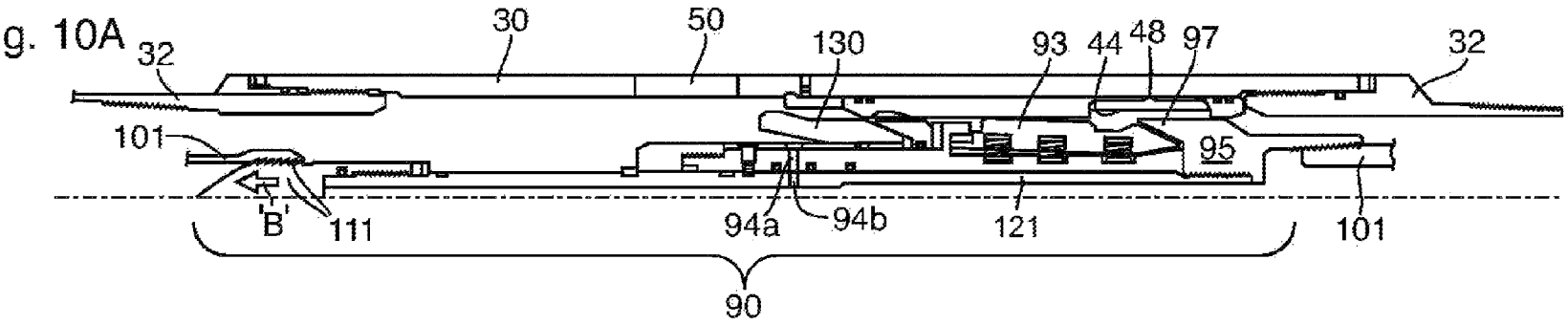
Figure 9B:
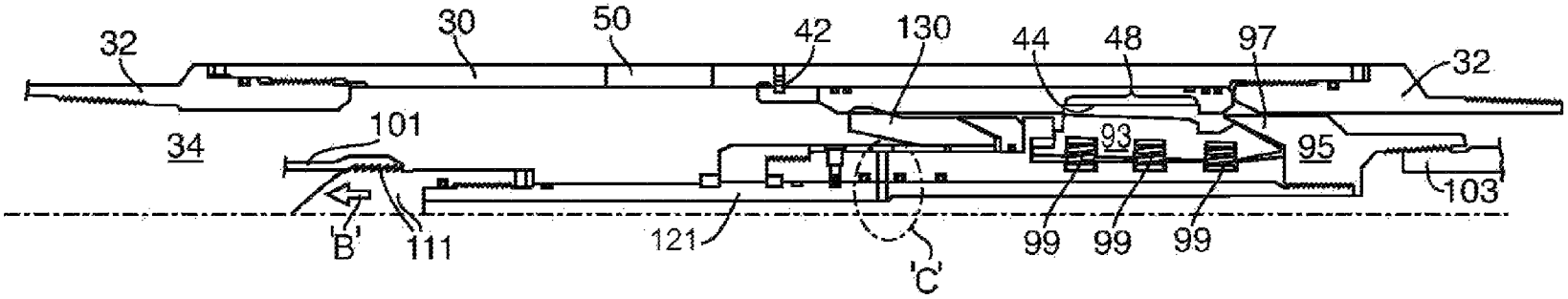
Figure 10B:
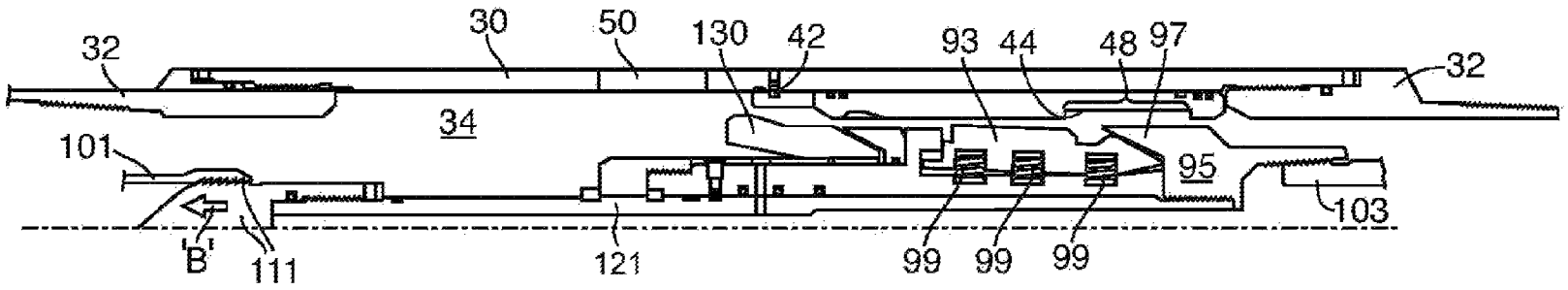
Figure 11:
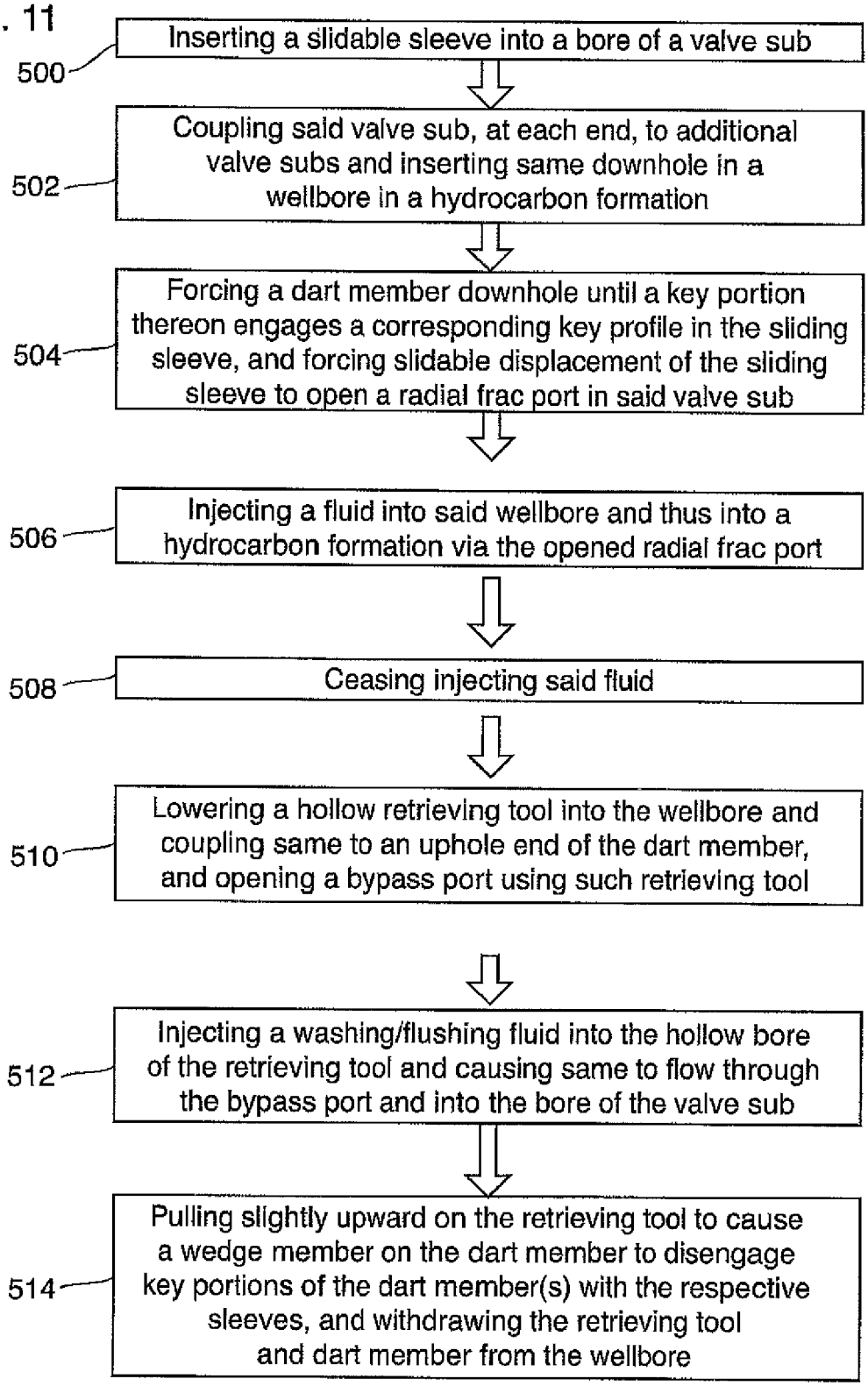
FIG. 11 is a flow diagram showing a method of operating the system of the present invention.

The operation of the embodiment of the system 10 shown in FIGS. 1-6 will now be broadly described, with reference to FIG. 11, which broadly applies equally to the method of FIGS. 1-6, and the method of operation of the system depicted in FIGS. 7A-10B.

Figure 7A:
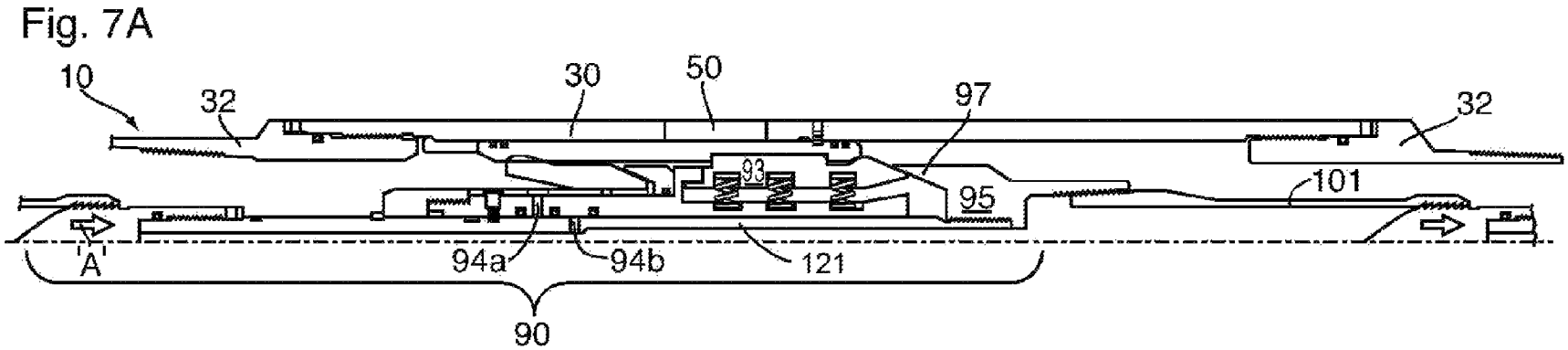

Specifically, as seen from step 500 of FIG. 11 for the method of the present invention, a slidable sleeve or sleeves 40 are inserted into respective valve subs 30. In the subsequent step 502, valve subs 30 are coupled together in end-to-end relation, and inserted downhole in a wellbore in a hydrocarbon formation. (Ref FIG. 1, and FIGS. 7A, 7B), specifically by, as in step 504, forcing a dart member 90 downhole. Such dart member 90 may be forced downhole by applying a fluid pressure to an uphole end thereof, or alternatively, as shown in FIG. 1 and FIG. 7A, coupling such dart member(s) 90 to an insertion tool 102 and forcing same downhole using such insertion tool 102. Key portions 93 on respective dart members 90 engage cylindrical grooves 48 on corresponding slidable sleeves 40, and continued downhole force on dart members 90 forces shearing of shear pins 42 and slidable downhole displacements of slidable sleeve(s) 40 and thus opening of frac port(s) 50 (ref. FIG. 2, and FIGS. 8A,8B).

Thereafter, as reflected in step 506, fluid is injected into bore 34 and thus into the hydrocarbon formation via ports 50 (ref. FIG. 3 and FIGS. 8A,8B).

Fluid injection is then ceased (step 508), and in a subsequent step 510 a hollow retrieving tool 101 (or the same insertion tool 102) is coupled to an uphole dart member 90, which retrieving tool 101 moves slidable member 121 to thereby open bypass port 94 (94*a*,94*b*) (ref. FIGS. 4,5 and 9A, 9B).

In step 512, a washing/flushing fluid is injected into hollow bore of retrieval tool 101, and such is caused to flow through the bypass port 94 (94*a*,94*b*) to lush the region of entrained sand to prevent impaction of dart members(s) 90. Open bypass ports 94 (94*a*,94*b*) thereby equalize pressure (ref. FIG. 4,5 and FIG. 9A, 9B).

Finally, as shown in step 514 retrieving tool 101 is pulled slightly upward to cause wedge member 95 on dart members(s) 90 to disengage key portion(s) 93 with respective sliding sleeve(s) 40, and the retrieving tool 101 and dart member(s) 90 are then withdrawn from the wellbore.

Specifically, as regards the embodiment of the invention shown in FIGS. 1-6, such system/method 10 contemplates use of a single dart member 90 to actuate a series of slidable sleeves 40 and thereby open a plurality of successive downhole sleeves 40 in a frac system 10. Specifically, coupling members 32 in such embodiment are provide with a "kick-over" portion 66 (ref. FIG. 2), which once a respective uphole sliding sleeve 40 is slid to the open position, the key portion 93 of dart member 90 contacts kick-over portion 66 so as to depress key portion 93 thereby causing disengagement of key portion 93 from the circumferential groove 48 of corresponding slidable member 40 and thereby permit dart member 90 to continue to progress downhole to similarly actuate a successively downhole slidable sleeve(s) 40 in a similar manner until a coupling member 32 is encountered which instead of a kick-over portion 93 possesses an angled portion 67 which prevents further kick-over and disengagement and thus further downhole movement of dart member 90, as shown in FIG. 3.

When in such position (FIG. 3) frac fluid can be injected in bore 34 to flow into the formation via each of the opened frac ports 50.

Figure 5:
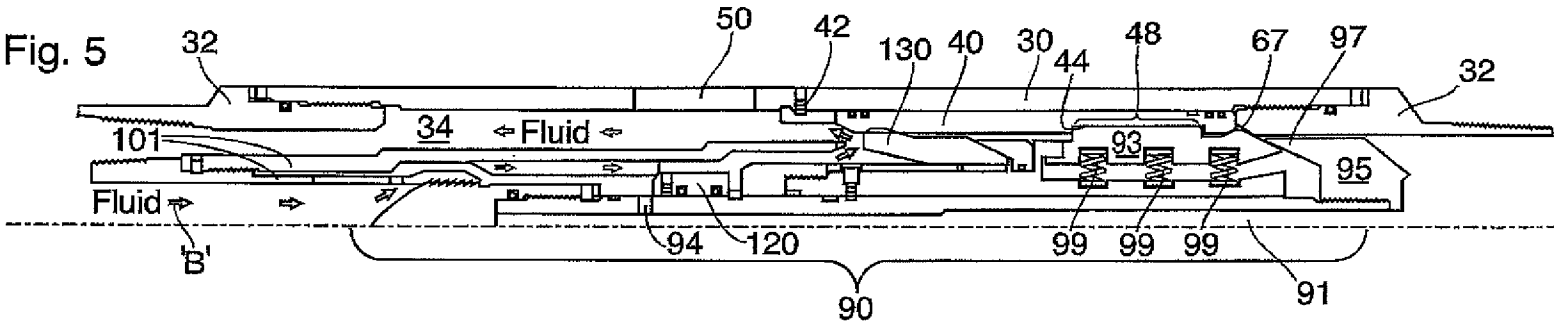

Thereafter, as shown in FIG. 4, a retrieving tool 101 may be inserted downhole and coupled to dart member 90 via a threaded coupling 121, as shown in FIG. 4, 5, and slidable member 120 simultaneously repositioned downhole via retrieving tool 101 to expose radial bypass port 94 (FIG. 5). A washing fluid (see arrows in FIG. 4, 5) can be injected into the interior 91 of hollow retrieving tool 101 and dart member 90, which washing fluid is then able to flow into valve sub interior 34 via bypass port 94 and out frac port 50, thereby removing any remaining frac fluid and/or entrained sand. Bypass port 94 may further equalize pressure within bore 34 and downhole of dart member 90 to allow the dart member 90 to then be withdrawn from valve sub 30 via retrieving tool 101 (ref. FIG. 6).

FIGS. 7A & 7B, 8A & 8B, 9A & 9B, and 10A & 10B together show a different embodiment/method of the present system 10, in particular and progressively through FIGS. 7-10, depict the manner of operation of such system 10 to open frac ports 50 by means of injecting a plurality of dart members 90 downhole (FIG. 7A, 7B), opening frac ports 50 (FIG. 8A,8B), disengaging the dart members 90 from the associated sliding sleeves 40 and aligning radial bypass ports 94*a*, 94*b* (ref. FIGS. 9A, 9B and region "C"), and finally subsequently withdrawing such dart members 90 uphole (ref. FIGS. 10A, 10B).

Notably, as compared to FIGS. 1-6, the system 10 depicted in FIGS. 7A-10B utilizes differently-located slidable member 121 which is further provided with a bypass port 94*b*. After dart member 90 (and further downhole dart members 90 connected in series via connecting members 103) are pushed downhole (FIG. 7A, 7B) and engage respective sliding sleeves 40 and further moves downhole to thereby open such respective sliding sleeves 40 and thus associated frac ports 50 (FIG. 8A, 8B), a frac fluid may then be injected in bore 34 to flow into the formation via opened frac ports 50 (ref. FIG. 8A,8B).

Thereafter, a retrieving tool 101 (which may be the same as the insertion tool 101 may be inserted downhole (FIG. 8A) and by means of a threaded coupling 111 become coupled to the most uphole dart member 40 (FIG. 8A).

Slight uphole movement of retrieving tool 101 in the direction of arrow "B" of FIG. 9A causes wedge shaped portion 97 of wedge members 95 to disengage each respective key portions 93 of associated dart members 90 with respective grooves 48 of slidable sleeves 40, to thereby release dart members 90 for uphole movement (ref. FIG. 9A, 9B). The slight uphole movement of retrieving tool 101 simultaneously moves slidable member 121 uphole so that bypass port 94*a* thereon becomes aligned with bypass port 94*b* on each of dart members 90.

Washing fluid which is injected downhole, preferably via hollow bore of retrieving tool 101, is then able to flow into valve sub interior 34 via bypass ports 94*a*, 94*b* and out frac ports 50, thereby removing any remaining frac fluid and/or entrained sand. Bypass ports 94*a*, 94*b* may further equalize pressure within bore 34 to allow dart members 90 to then be withdrawn from the respective valve subs 30 via retrieving tool 101 (ref. FIG. 10A, 10B) when retrieving tool 101 is further moved in the direction of arrow 'A'.

Use of examples in the specification, including examples of terms, is for illustrative purposes only and is not intended to limit the scope and meaning of the embodiments of the invention set out and described in the disclosure. Numeric ranges are inclusive of the numbers defining the range. In the specification, the word "comprising" is used as an open-ended term, substantially equivalent to the phrase "including, but not limited to," and the word "comprises" has a corresponding meaning.

The scope of the claims should not be limited by the preferred embodiments set forth in the foregoing examples, but should be given the broadest interpretation consistent with the description as a whole, and the claims are not to be limited to the preferred or exemplified embodiments of the invention.

The embodiments in which an exclusive property and privilege is claimed are set out in the following claims:

1. A system for permitting injection of fluid into an underground formation at one or more selected locations along a longitudinal length of a wellbore within said underground formation, the system comprising:

(i) a plurality of hollow cylindrical valve sub-members insertable in said wellbore, each having coupling means at opposite ends thereof for physically coupling said valve sub-members together in an end-to-end relation, each valve sub-member having a bore and at least one of said sub-members having a radial frac port for permitting radial egress of fluid from within said bore of said at least one valve sub-member to an exterior of said at least one valve sub-member and thereby into said underground formation when said sub-members are inserted in said wellbore;

(ii) a hollow cylindrical slidable sleeve, said hollow slidable sleeve:

longitudinally slidable within said one of said valve sub-members, from a first closed position where it is initially maintained via a shear pin in a position covering said radial frac port, to an longitudinally downhole second open position where said radial frac port is uncovered by said hollow slidable sleeve;

having a key profile in an interior surface thereof; and having lock means configured to maintain said hollow slidable sleeve in said open position when said slidable sleeve is moved to said open position from said closed position;

(iii) an elongate retrieving tool;

(iv) a dart member, having a hollow bore, insertable within said slidable sleeve, having a cylindrical radially-outwardly biased key portion thereon configured to engage said key portion on said slidable sleeve when said dart member passes within said hollow slidable sleeve and allow said dart member to thereby engage and couple said dart member to said slidable sleeve to move said hollow slidable sleeve downhole from said closed position to said open position, said dart member further comprising:

(a) a wedge member, longitudinally slidably moveable within said dart member, having a wedge-shaped portion thereon positioned downhole of said radially-outwardly biased key portion which wedge-shaped portion when pulled uphole depresses said radially-outwardly biased key portion thereby causing disengagement of said key portion on said dart member with said key profile in said cylindrical slidable sleeve to permit said dart member to be withdrawn uphole by said retrieving tool;

(b) a radial bypass port;

(c) a slidable member, covering, in a first position, said radial bypass port and not covering said radial bypass port when in a second position;

wherein the cylindrical radially-outwardly biased key portion of said dart, when said dart is forced downhole within said hollow cylindrical sub-members, engages said key profile on said slidable sleeve and thereby slides said slidable sleeve downhole to thereby open said radial frac port to permit injection of a fluid into said formation; and wherein said retrieving tool:

(a) is configured to be affixed to said dart member, and further configured when affixed to said dart member or when being affixed to said dart member, to move said slidable member to said second position to expose said radial bypass port; or (b) is configured to be affixed to said dart member and when affixed to said dart member and upon movement uphole of said retrieving tool and dart member, moves said slidable member to said second position to expose said radial bypass port;

to thereby permit withdrawal of said dart member uphole from within said wellbore by said retrieving tool.

2. The system as claimed in claim 1, said dart member having coupling means thereon, said coupling means configured to permit said dart member to be coupled to said retrieving tool.

3. The system as claimed in claim 2, wherein said retrieving tool is configured so that when coupled or during coupling to said dart member, said retrieving tool moves said slidable member to said second position to expose said radial bypass port.

4. The system as claimed in claim 2, wherein said slidable member is coupled to said wedge-shaped member, and said retrieving tool is coupled to said slidable member; and wherein movement of said retrieving tool uphole causes said slidable member to move to said second position exposing said bypass port and causing said wedge-shaped member to disengage said key member from within said circumferential groove.

5. The system as claimed in claim 1, wherein said key profile on said slidable sleeve comprises a circumferential groove about said interior surface of said slidable sleeve; and said cylindrical radially-outwardly biased key portion on said dart member comprising at least one radially outwardly protruding annular member of a width less than or equal to said circumferential groove on said slidable sleeve that it is intended to engage.

6. The system as claimed in claim 5 for successively opening the plurality of valve sub-members, wherein:

a) said circumferential groove in an uphole slidable sleeve within an uphole valve sub-member is of the same width as a cylindrical groove of a downhole slidable sleeve within an adjacently coupled downhole valve sub-member; and b) said downhole or uphole valve sub-member having a contact surface for depressing inwardly said radially-outwardly biased member on said dart member when said uphole slidable sleeve has repositioned to said second open position, so as to permit said dart member to be disengaged from said circumferential groove in said uphole slidable sleeve thereafter continue to progress downhole for further engagement with one or more slidable sleeves of downhole valve sub-members to thereby successively open further downhole radial frac ports in said downhole valve sub-members.

7. The system as claimed in claim 1, wherein the plurality of valve sub-members respectively contain a corresponding plurality of slidable sleeves, each key profile thereon comprising a circumferential groove; and each circumferential groove is of a lesser width than the circumferential groove within a slidable sleeve of a most proximate downhole valve sub-member; and the radially-outwardly biased portion on said dart member being of a width corresponding to that of said circumferential groove on the slidable sleeve which said radially-outwardly biased portion on said dart member is intended to engage.

8. The system as claimed in claim 1 wherein:

said dart member possesses a seal member situated on said dart member, uphole from said radially-outwardly biased key portion; and said radial bypass port is situated on said dart member uphole from said seal member.

9. A method of opening at least one radial frac port along a wellbore via a dart member to thereby allow injection of fluid into a hydrocarbon formation via said frac port, and thereafter using a retrieving tool to further open a bypass valve and allow removal of both the retrieving tool and the dart member from the wellbore while reducing sand impaction, comprising the steps of:

(A) providing:

(i) a plurality of hollow cylindrical valve sub-members insertable in said wellbore, each having coupling means at opposite ends thereof for physically coupling said valve sub-members together in an end-to-end relation, each valve sub-member having a bore and at least one of said sub-members having a radial frac port for permitting radial egress of fluid from within said bore of said at least one valve sub-member to an exterior of said at least one valve sub-member and thereby into said underground formation when said sub-members inserted in said wellbore;

(ii) a hollow cylindrical slidable sleeve, said hollow slidable sleeve:

longitudinally slidable within said one of said valve sub-members, from a first closed position to an longitudinally downhole second open position where said radial frac port is uncovered by said hollow slidable sleeve;

having a key profile in an interior surface thereof; and having lock means configured to maintain said hollow slidable sleeve in said open position when said slidable sleeve is moved to said open position from said closed position;

(iii) said retrieving tool having a hollow bore;

(iv) said dart member, having a hollow bore, insertable within said slidable sleeve, having a cylindrical radially-outwardly biased key portion thereon, configured to engage said key profile on said slidable sleeve when said dart member passes within said hollow slidable sleeve and allow said dart member to be coupled to said slidable sleeve and cause said slidable sleeve to move downhole from said closed position to said open position, said dart member further comprising:

(a) a wedge-shaped member, slidably moveable within said dart member, having a wedge portion thereon positioned downhole of said radially-outwardly biased key portion which wedge-shaped portion when pulled uphole depresses said radially-outwardly biased key portion thereby causing disengagement of said key portion on said dart member with said key profile in said cylindrical slidable sleeve to permit said dart member to be withdrawn uphole by said retrieving tool;

(b) a radial bypass port;

(c) a slidable member, covering, in a first position, said radial bypass port and not covering said radial bypass port when in a second position;

(B) inserting said slidable sleeve into said bore of at least one of said valve sub-members:

(C) coupling said valve sub-members together in an end-to-end relation, and inserting them downhole in said wellbore;

(D) forcing said dart member downhole in said wellbore until said cylindrical radially-outwardly biased key portion on said dart member engages said key profile in said slidable sleeve and causing slidable displacement of said sliding sleeve from said first position to said second position thereby opening said radial frac port;

(E) injecting a fluid into said hydrocarbon formation via said opened frac port;

(F) ceasing injection of said fluid;

(G) lowering said hollow retrieving tool into said wellbore and coupling said retrieving tool to an uphole end of said dart member, and via said retrieving tool, sliding said slidable member downhole to thereby open said bypass port;

(H) injecting a washing fluid into said hollow bore of said retrieving tool and causing same to flow through said bypass port and into the bore of the valve subs and to be flushed uphole and/or out said frac port; and (I) withdrawing said retrieving tool and said dart member from said wellbore.

10. The method as claimed in claim 9, wherein said forcing of the dart member downhole is effected by application of pressurized fluid to an uphole side of said dart member.

11. The method as claimed in claim 9, wherein said forcing of the dart member downhole is effected by an insertion tool, having said dart member situated at a distal end thereof.

* * * * *